US005253461A

United States Patent [19]

Janoski et al.

[11] Patent Number: 5,253,461

[45] Date of Patent: Oct. 19, 1993

[54] FASTENER-FREE ROOFING SYSTEM AND METHOD

[75] Inventors: Ronald J. Janoski, Chagrin Falls; Gregory Rudolph, Novelty; Rick J. Gibson, North Olmsted; Donald C. Portfolio, Solon, all of Ohio

[73] Assignee: Tremco, Inc., Beachwood, Ohio

[21] Appl. No.: 633,561

[22] Filed: Dec. 21, 1990

[51] Int. Cl.[5] ..... E04B 1/74; E04D 11/02; E04G 23/00

[52] U.S. Cl. ..... 52/408; 52/411; 52/746; 156/71

[58] Field of Search ..... 52/741, 746, 408, 409, 52/410, 411, 741.4; 156/71

[56] References Cited

U.S. PATENT DOCUMENTS

| | | | |
|---|---|---|---|
| 3,094,447 | 6/1963 | Chamberlain | 52/746 |
| 3,980,597 | 9/1976 | Shihadeh | 524/705 |
| 4,597,817 | 7/1986 | Larsen | 52/746 |
| 4,793,886 | 12/1988 | Okamura et al. | 156/307.3 |
| 4,950,701 | 8/1990 | Okamura et al. | 524/237 |
| 5,008,311 | 4/1991 | Janoski | 524/59 |

*Primary Examiner*—Michael Safavi

*Attorney, Agent, or Firm*—Konrad H. Kaeding; Alfred D. Lobo; David P. Dureska

[57] ABSTRACT

The present invention relates to low slope roofing systems, particularly in commercial (as opposed to residential) roofing applications. More specifically, the fastener-free roofing system of the present invention is directed to the use of a curing adhesive composition which will simply and safely secure roofing insulation to a roofing deck without the need for mechanical fasteners.

18 Claims, 1 Drawing Sheet

FASTENER-FREE ROOFING SYSTEM AND METHOD

FIELD OF THE INVENTION

The present invention relates to a roofing system for a roof deck which is not steeply inclined, such as is found in commercial, as opposed to residential roofs. More specifically, the fastener-free roofing system of the present invention is directed to the use of a curable adhesive composition which will simply and safely secure roofing insulation to a roof deck without the need for mechanical fasteners.

BACKGROUND OF THE INVENTION

Flat Roofs in General

In the roofing art, and in this specification, "flat roof" refers to a roof having a slope of less than about 25° relative to a horizontal plane. Many such roofs are substantially flat with a slight incline to allow water to run off. Some flat roofs comprise numerous sloping sections which create peaks and valleys, and a water drain is generally located at the bottom of each valley to facilitate water drainage. Flat roofs traditionally comprise three basic components (from top to bottom): (1) a waterproof membrane (top); (2) thermal insulation (middle); and (3) the structural deck (bottom).

The waterproof membrane typically comprises two or more plies of a felt membrane in combination with bitumen (generally coal tar pitch or asphalt). The felt stabilizes and strengthens the bitumen, and distributes contractive tensile stress when the bitumen is cold and glasslike. Alternatively, the membrane can be a polymeric sheet or a series of polymeric sheets adhered together to form seams where they are joined.

The membrane is typically used in combination with metallic and/or nonmetallic flashings which guard against leakage through portions of the membrane which are pierced or terminated, such as at gravel stops, walls, curbs, expansion joints, vents and drains.

Mineral aggregate (normally gravel, crushed rock, or slag) is often spread atop the membrane to hold it down on the roof deck and protect the membrane from wind, rain, solar radiation, and fire. Such aggregate may be unnecessary on smooth-surfaced asphalt roofs having glass-fiber felts.

Conventional membranes cannot resist large movements of the deck, or insulation covering it, and will be punctured by heads of fasteners which protrude above the insulation due to such movements. Membrane puncture (due to fastener heads, foot traffic or the like) and undue membrane shifting or movement (due to foot traffic, wind forces or the like) are primary causes for leaks in flat roofs which have been properly installed.

Roofing Insulation

The second basic component of a flat roof is the roofing insulation installed just beneath the membrane. Insulation may be provided by several materials, such as rigid insulation prefabricated into boards, or poured insulating concrete fills (sometimes topped with another more efficient rigid board insulation).

The roofing insulation preferably has adequate shear strength to distribute tensile stresses in the membrane to prevent it splitting. The insulation should also have adequate compressive strength to withstand traffic, and the impact of hailstones. Furthermore, the insulation should have sufficient adhesive and cohesive strength to resist delamination due to wind uplift forces and the like. Finally, the dimensional stability should be sufficient to withstand thermal and moisture cycles.

The Roof Deck

The final component of a flat roof is the structural deck which lies below the insulation. The roof deck is generally a metal, concrete, gypsum or wood substrate which is generally integral with the building's basic structure upon which substrate the rest of the roof is built up.

Uplift Forces Due to Winds

Forces generated by wind currents are generally much greater at the top of most commercial buildings than they are at ground level, and the taller the building, generally the greater the wind forces upon a roof. Wind uplift pressure can damage a roof or even blow it off, unless it is properly anchored to the building.

Leaks Due to Improper Anchoring of Insulation

However, wind is not the only reason to firmly fasten down a roof. Unanchored insulation boards increase the risk of membrane splitting. Internal stresses produced by thermal and moisture changes in the membrane on a flat roof has a tendency to exert a ratcheting action on poorly anchored insulation. Flexible membrane expands and contracts during thermal cycles, thereby producing a cumulative ratcheting action toward the center of the roof. Over time, this ratcheting action can pull the insulation from the roof's edges, destroying the effectiveness of the edge flashing and of the roof.

Mechanical fasteners can be used to secure the insulation to the roof deck. However, corrosion can be a problem. Although such fasteners can be coated with specialized anti-corrosive metals or polymers, such coatings can be partially removed as the fastener is ratcheted in place due to roof movement. Even a small breach in the coating can be sufficient to allow corrosion to infiltrate the entire fastener. Non-metal fasteners are perhaps possible, but would be very expensive due to the physical properties needed for such a fastener system. Even where the fastener does not corrode, fasteners will generally expand and contract with temperature changes, and holes through which fasteners are driven are therefore prone to enlarge over time, causing the fastener's holding ability to fail, or the fastener to back out through the membrane. Fasteners are also a problem because they provide the opportunity for moisture to penetrate into the insulation.

Any leak in the membrane will generally cause water to flow to a fastener head, since the fasteners generally make indentations in the insulation they are anchoring (indeed, a leak in the membrane will often be near the head of a fastener because the head has punctured the membrane due to a fastener backing out, for example due to foot traffic).

The use of fasteners is also labor intensive and subject to errors of workmen installing insulation on the deck. Eliminating fasteners for the insulation eliminates the possibility they might protrude through the insulation.

SUMMARY OF THE INVENTION

Many failed attempts substantially to satisfy the need for a fastener-free roofing system are of record in the art. The inventors herein have discovered that a surprisingly reliable roofing system may be formulated with an adhesive having desirable penetration and adhesion characteristics and desirably quick curing times.

It is therefore an object of the present invention to provide a fastener-free roofing system which is inexpensive, easy to install and less prone to failure than conventional flat roof systems. Other objects and features of the present invention will become apparent to one of ordinary skill in the art, upon further reading of this specification and subsequent claims.

The preferred roofing system of the present invention can be used with virtually any building having a roof deck which is not steeply inclined. The roofing system comprises a dispersion of a polyol and asphalt, or of a polyisocyanate prepolymer and asphalt as the adhesive which upon curing, secures a roofing panel (preferably of insulation) to a roof deck. Optionally, a vapor barrier can be placed between the roof deck and roofing insulation, and in this embodiment, the roofing adhesive is placed on each side of the vapor barrier.

The adhesive of the present invention can also be used between insulation panels, between an insulation panel and the roofing membrane and also between membrane layers or sections. The adhesive of the present invention is relatively inexpensive, reliable and easy to use.

The roof deck can be metal, wood, concrete, gypsum, or the like. The roofing insulation is preferably a rigid board made from either organic or inorganic materials.

Other curing systems may include epoxy, acrylate, cyanoacrylates, silicone, and silane-hydration-condensation curing systems. The curing system can be a "one-part" or a "two-part" system. The most preferred curing systems are those which cure in about an hour. However, ordinary skill and experimentation might be required to adjust the rate of cure for any particular adhesive system used in an alternative embodiment of the present invention.

The adhesive of the present invention is preferably substantially solvent-free, readily curable at typical ambient temperatures and preferably comprises a one-part dispersion of a polyisocyanate prepolymer and asphalt, or a two-part dispersion of a polyol and asphalt to which an isocyanate is added prior to applying a mixture of the two parts. Either dispersion optionally contains a filler. The preferred curing system is a one-part, isocyanate end-capped polyurethane prepolymer. A critical aspect of the present invention is that the adhesive has wetting and interdiffusion capability and quick cure time.

The most preferred adhesive is a dispersion wherein asphalt which is liquid or semi-liquid at room temperature is suspended within a liquid prepolymer which is substantially solvent-free yet has substantial surface wetting capability. As a result, the liquid prepolymer can substantially wet the surface of the deck and also the surface of the insulation. The bitumen or asphalt particles suspended within the prepolymer droplets will generally not interfere with curing. Furthermore, bitumen and asphalt have some penetration and adhesion properties which might be advantageous. Such surface wetting is possible by applying the prepolymer without a substantial amount of asphalt or solvent carrier; however, such a system is not only uneconomical but also difficult to work with.

The filler referred to above may be calcium carbonate, carbon black, clay, diatomaceous earth, or other commonly used fillers. Preferably such fillers are vigorously mixed into the prepolymer and most preferably suspended within prepolymer droplets. Ordinary skill and experimentation may be necessary to formulate an adhesive containing a filler which is not suspended in the prepolymer. A compatibilizing agent is necessary to obtain the dispersion of asphalt in prepolymer or polyol.

Long cure times are generally disadvantageous, because the roof deck can shift due to wind forces or the like and deck may flex from traffic causing non-contact. Non-solvent adhesive systems of the present invention generally remain tacky and are capable of accommodating shifting, but will then quickly cure. Therefore deck shifts and irregularity are generally less of a problem in obtaining adequate adhesion. For porous insulation, such as fiber insulation, the adhesive must penetrate and anchor itself into the insulation fiber.

The adhesive's filler and/or solvent must not substantially separate from the curing component as the insulation adhesive penetrates into the porous substrate. As the adhesive component cures, the polymer matrix should not be unduly interrupted by filler agglomerations or the like.

The roofing adhesive is preferably temperature insensitive, particularly in the temperature range from about −40° F. (−40° C.) to about 160° F. (70° C.). The optimal coverage rate of the roofing adhesive is preferably about 0.5 to about 2 gals/100 $ft^2$ (gallons per hundred square feet), more preferably, 0.7 to about 1.5 gals/100 $ft^2$.

BRIEF DESCRIPTION OF THE DRAWINGS

The FIGURE is a perspective view, with portions cut away, schematically illustrating a roof assembly constructed in accordance with the preferred embodiment of the present invention.

DETAILED DESCRIPTION OF PREFERRED EMBODIMENTS

Figure 1:
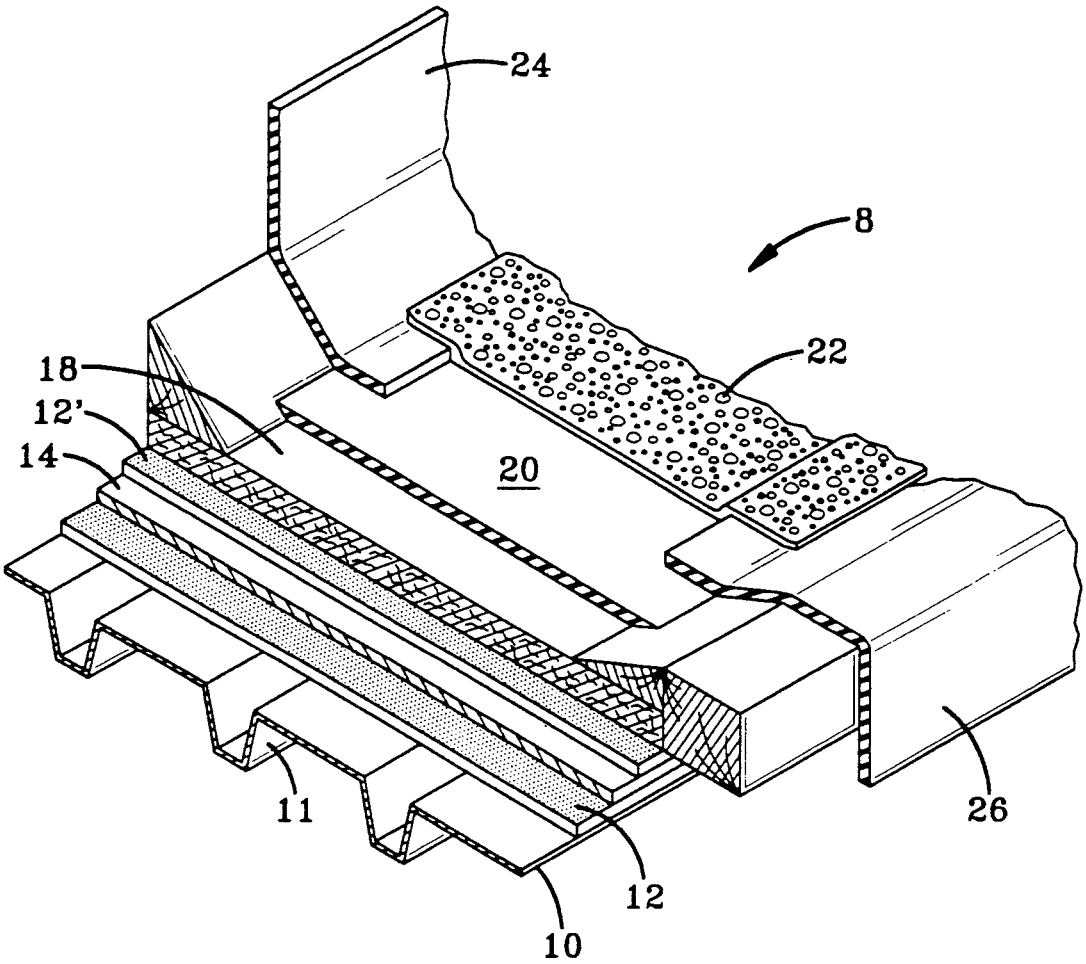

The preferred roofing system of the present invention is shown generally at 8 in FIG. 1. Virtually any building having a roof deck (such as the metal deck shown at 10) can embody the present invention. The preferred roofing system comprises the adhesive 12 which secures the roofing insulation to the roof deck. Optionally, a vapor barrier 14 can be placed between the roof deck 10 and roofing insulation 18, and in this embodiment, the roofing adhesive 12 and 12' is placed on each side of the vapor barrier 14. A roofing membrane 20 is adhered to the roofing insulation by conventional means or with the insulation adhesive 12. The insulation adhesive can also be used to adhere insulation panels to one another. Aggregate 22 can be placed upon the membrane as an added protective layer. Finally, flashing members 24, and 26 are used to waterproof the edges of the building.

The Roof Deck

The roof deck 10 is integral with the primary support structure of the building and able to resist gravity loads, lateral loading from wind and seismic forces. Deck 10 is preferably about 18–24 gauge, cold rolled, galvanized steel having ribs 11 which are spaced apart at regular intervals such as about 6 inches on center and preferably define a depth of a few inches or so. Conventional prefabricated decks can also be used. Alternatively, the deck can be wood, gypsum or concrete. The wood sheathing can be sawed lumber or plywood.

If the deck is concrete, it can be lightweight or structural concrete and can be cast in place or precast. A cast in place structural deck is preferably continuous, except where interrupted by an expansion joint or another building component. Gypsum can also be used in the practice of the present invention. A gypsum deck is preferably poured on gypsum formboards spanning flanges of closely spaced steel bulb tees. Such cast in place decks generally present large seamless expanses of roof surface, except where expansion joints are used to impede cracks from thermal contraction or drying shrinkage. The roof deck can also comprise mineralized wood fiber comprising long wood fibers bonded with a mineral or resinous binder and formed under a combination of heat and pressure.

Preferably, the structural framing and deck are sloped to thereby provide an inclined roofing surface. The slope is preferably at least about ¼th of an inch per foot. Such an incline is generally advantageous, since it will generally facilitate water run off and drainage. Although the present invention will generally work, at least to some degree, with roofs which pond water, such a roofing design is not preferred. Tapered insulation may be used to create a slope.

The insulation 18 of the present invention is preferably a rigid board insulation, either organic or inorganic. The organic insulation includes the various vegetable-fiber boards and foamed plastics. Inorganic insulation includes glass fiber, perlite, and wood fiber board.

The board insulation can be cellular or fibrous. Cellular insulation includes foamed glass and foamed plastics, such as polystyrenes, polyurethanes and polyisocyanates.

Fibrous insulation includes various fiberboards, which can be made of wood, cane, or vegetable fibers. The materials can be impregnated or coated with asphaltic materials to make them more moisture resistant. Fibrous glass insulation consists of nonabsorbent fibers formed into boards with resinous binders and can be surfaced with an organic material, such as paper.

Perlite board contains both inorganic (expanded siliceous volcanic glass) and organic (wood fibers) materials bonded with asphaltic binders.

Composite boards comprise a cellular plastic insulation on top and perlite, fiberglass, or fiberboard laminated on the bottom.

The cohesive strength within the insulation must be at least equal to the required wind uplift resistance designed for the roof system to prevent the insulation from breaking in high winds.

Adhering Insulation To The Roof Deck

To secure the roofing insulation to the roof deck, an appropriate adhesive is necessary. The problem with many decks, particularly steel decks, is that they tend to deflect due to wind, surface traffic or the like. The adhesive 12 used in the present invention preferably has sufficient elasticity to withstand conventional deflections, even by a steel deck, without diminishing the bond strength between the deck and insulation. The adhesive 12 is preferably capable of substantially maintaining adhesive integrity even after normal steel deck deflection, and the adhesive preferably has sufficient elasticity and adhesiveness to diminish dishing or differential deflection due to wind, foot traffic or the like.

Furthermore, the adhesive 12 quickly obtains bond strength. The adhesive preferably provides sufficient adhesion between a roof deck and insulation to withstand about 90 pounds per square foot uplift. Bonding sufficient to withstand 90 pounds per square foot uplift should be obtained within about 24 hours, more preferably 5 hours. In just two hours under favorable conditions (40–80% relative humidity, 18°–23° C.).

Upon full cure, preferably within about 24 hours, the adhesive is preferably able to resist 100 pounds per square foot and more preferably 115 pounds per square foot or more.

The curing system can be one-part or more than one part. The most preferred curing systems are those which gel in about an hour. Where curing substantially occurs within 5 minutes or less, often there is insufficient time for the workers to apply the insulation upon the applied adhesive layer, and if so, the adhesive will cure without adequate bonding to the insulation substrate. However, where substantial curing occurs only after more than about 24 hours, deflections in the roof deck, particularly in a steel roof deck, will often tear the insulation away from the deck prior to full adhesive curing, substantially increasing the possibility of adhesive failure or non-contact and non-penetration into the insulation. Ordinary skill and experimentation might be required to adjust the rate of cure for any particular adhesive system used in an alternative embodiment of the present invention.

The adhesive 12 is preferably substantially solvent-free, readily curable at typical ambient temperatures and relative humidity. The preferred curing system is a one-part, isocyanate based moisture curing system. Other curing systems are also possible, such as two part isocyanate or urethane systems, one or two part epoxide systems, room temperature curable polysulfide systems, silicone, and the like, provided the curing system is capable of providing 90 pounds per square foot uplift resistance in less than about 24 hours. Ordinary skill and experimentation may be necessary in optimizing any alternative curing system used in an alternative embodiment of the present invention.

The most preferred adhesive is substantially solvent-free and has substantial surface wetting capability.

The most preferred method of adhesion is to have an inverse dispersion wherein asphalt, and optionally a filler, is suspended within an organophilic liquid prepolymer. As a result, the liquid prepolymer can substantially wet the surface of the metal.

The most preferred filler is asphalt or bitumen, particularly asphalts or bitumens which are liquid or semi-liquid at room temperature. The bitumen or asphalt particles suspended within the prepolymer droplets will generally not interfere with curing. Furthermore, bitumen and asphalt have some penetration and adhesion properties which might be advantageous. A compatibilizing agent is necessary to obtain an inverse dispersion.

Other fillers might also be used, such as calcium carbonate, clay, diatomaceous earth and the like. Preferably such fillers are vigorously mixed into the prepolymer and most preferably suspended within the prepolymer.

Where dispersion of the filler is not obtained, then the filler can interfere with the prepolymer wetting onto the surface and subsequent cure. Ordinary skill and experimentation therefore may be necessary in formulating any adhesive having a filler which is suspended in the prepolymer.

As mentioned above, solvents are less preferred. Long cure times are generally disadvantageous, because the roof deck can shift due to wind forces or the like and substantially diminish potential adhesion. The non-solvent system of this invention generally remains tacky and capable of accommodating shifting and will then quickly cure.

Adhesion is not only important with respect to the surface coating on the metal deck, it is also important in wetting the surface of the insulation. For porous insulation, such as fiber insulation, or for a porous roof deck, such as concrete or wood, the organophilic adhesive must penetrate and anchor itself into the porous substrate. The amount of penetration to anchor the adhesive into the insulation (and porous roof deck, if used) may have to be determined by routine experimentation.

The adhesive's filler and/or solvent should not substantially separate from the curing component as the insulation adhesive penetrates into the porous substrate. As the adhesive component cures, the polymer matrix should not be unduly interrupted by filler agglomerations or the like.

Before the adhesive can be applied to the roof deck, the surface should be chemically or mechanically cleaned using conventional methods. Also a conventional primer can be used.

The Most Preferred Insulation Adhesive

The preferred insulation adhesive of the present invention comprises a base material (asphalt) component, a liquid prepolymer ("curable") component, and a non-volatile compatibilizer. The base material component is used primarily due to its low cost, although such components may also provide advantageous properties, such as good wetting, reinforcement value and/or waterproof and weather resistance properties. The prepolymer component is primarily present to polymerize within the base material subsequent to application, thereby providing a polymer network within the base material which provides strength and cohesion (the polymer network preferably contains urethane groups or the like which also provide desirable elastomeric properties and chemical bonding to surfaces). The compatibilizer is used to promote intermixing of the prepolymer and the base material and maintain a stable suspension.

The Adhesive's Base Material Component

The base material component can be any substantially non-volatile organic material, such as bitumen, asphalt, tar, substantially non-volatile petroleum based materials, and the like. The asphalt or bitumen component is most preferred and can be any commercially available bitumen material common to the industry. Preferably, the bitumen is substantially free of water and is substantially free of heterocyclic compounds or compounds which have reactive sites which will react with isocyanates.

It has also been found that base materials with low softening points, such as less than about 200° F. and preferably about 120° F. or less, generally work better in the present invention than base material with higher softening points. The lower softening points generally provide easier intermixing with the prepolymer when using the compatibilizer in this invention than base materials with higher softening points.

A plasticizer or other non-reactive diluent is preferably added to the base material to further soften the base material, making it easier to intermix with the prepolymer component.

The base material component can sometimes contain reactive sites which will react with the prepolymer component, such as: thio (—SH) or amino (—$NH_2$) functional groups and the like. Such reactive sites can be detrimental to the preferred embodiment of the present invention, particularly in a one component version of the present invention (one and two component systems are discussed below in the section entitled "Curing").

Therefore to prevent unwanted reaction between these reactive sites and the prepolymer component, the asphalt should first be pretreated with a blocking group, such as a reactive isocyanate (such as a para-toluene-sulfonyl isocyanate or the like), anhydride or carbodiamide. Suitable blocking agents include phthalic anhydride, succinic anhydride, or maleic anhydride. The anhydride will generally also dispose of any water within the base material, and water has been found generally to also be detrimental to the preferred embodiment of the present invention. The preferred amount of blocking group to be added to the asphalt is about 0.0 to about 5 weight percent, although the optimal amount of the blocking group can depend upon the particular end-use of the material and the type of base material, and therefore the blocking agent may have to be determined by ordinary skill and experimentation.

The Adhesive's Prepolymer Component

A second component of the preferred embodiment of the present invention is a liquid curable prepolymer, most preferably a polyisocyanate prepolymer system. This preferred polyisocyanate prepolymer is formed from the reaction of an organic polyisocyanate, preferably a diisocyanate, and an organic polyol. The hydroxyl group of the polyol will react with the isocyanate group of the polyisocyanate, and the resulting addition reaction will link the polyol to the polyisocyanate, creating a urethane at the junction of the previously separate molecules. The basic reaction of the diisocyanate with the hydroxyl is a hydrogen exchange, where the hydrogen of the polyol attaches itself to the carbon of the isocyanate, and conversely, the hydrogen of the isocyanate becomes attached to the hydroxyl oxygen, becoming a urethane.

However, the isocyanate functional groups are preferably in substantial excess, and therefore, the polyol molecules will add to the polyisocyanate molecules until the polyol molecules are substantially or completely depleted, and the resulting (prepolymer) molecules will have unreacted isocyanate functional end groups. The resulting molecules preferably have about 1 to about 10 isocyanate functional groups per molecule.

The prepolymer therefore contains rather large molecules having isocyanate functional end groups. The functional groups will be reaction sites during curing. Curing is discussed below under the section heading "Curing".

Virtually any polyisocyanate can be used, including for example methylene di-para-phenylene isocyanate ("MDI"), toluene diisocyanate, polymethylene-polyphenylene-diisocyanate, isophorone diisocyanate, and mixtures thereof. Triisocyanates and higher polyisocyanates also work well. The most preferred polyisocyanates are aromatic polyisocyanates, such as MDI.

Suitable polyols (for reacting with the polyisocyanate to thereby form the polyisocyanate prepolymer) preferably have urethane or urea forming constituents, such as polyether polyols and less preferably polyester polyols, including diols and triols such as glycerine. However, acrylated polyols do not work well in the present invention. Suitable polyols include ethylene glycol, propylene glycol, diethylene glycol, polybutadiene polyols, polytetrahydrofuran polyols, and polycarbonate polyols, and caprolactone-based polyols. Such polyols can be reacted with an alkylene oxide including ethylene oxide, propylene oxide and butylene oxide for example, to form polyether polyol adducts useful in forming the polyisocyanate prepolymer. The polyol can have a weight average molecular weight ranging from as low as about 250 to about 10,000 or more. Less preferred polyols are polyester polyols, since they have been found to be rather water sensitive and somewhat more temperature sensitive.

The polyisocyanate prepolymer is mixed with one or more non-reactive diluents, preferably plasticizers. These non-reactive diluents advantageously modify (typically decrease) the viscosity of the material. The preferred non-reactive diluents also typically make the end product less temperature sensitive, i.e., more durable when used at temperatures greater than about 150° F. Preferred plasticizers include dibutoxyethyl phthalate ("DBEP"), diisodecyl phthalate ("DIDP"), dibutyl phthalate ("DBP"), butylbenzyl phthalate ("BBP"), dioctyl phthalate ("DOP"), dioctyl sebacate ("DOS"), dioctyl adipate ("DOP") and diethylbutyl sebacate ("DEBS"), dibutoxyethoxyethyl sebacate, dibutoxyethyl sebacate, dibutyl sebacate, dioctyl dodecanedioate, diisooctyl dodecanedioate, dioctyl sebacate, dioctyl sebacate (substituted), triisooctyl trimellitate, trioctyl trimellitate, diisooctyl adipate, dioctyl adipate, dioctyl azelate, long chain alkyl alkylether diester, dialkyl diether glutarate, dibutoxyethoxyethyl glutarate, dibutoxyethyl glutarate, tributyl phosphate, and still bottom phosphate plasticizers. Plasticizers derived from phthalic acid are more preferred, and butylbenzyl phthalate is most preferred. The plasticizer reduces the viscosity of the prepolymer and the asphalt, making them more fluid and therefore somewhat easier to intermix.

The amount of prepolymer used in the present invention should be adequate to provide a coherent, substantially homogeneous mass. Typically this will mean that the prepolymer is present in a weight percentage of about 20–90%, preferably about 50%.

The Adhesive's Compatibilizer Component

The third ingredient of the preferred embodiment of the present invention is a compatibilizer which is defined as any material which will aid in inverting the base material within the liquid prepolymer system, and aid in causing the base material to be dispersed within the liquid prepolymer system. The most preferred compatibilizer is a surfactant-type material, having a substantially non-polar portion and a substantially polar-organic portion. The most preferred compatibilizer comprises a polymer unit, or two such units being either identical or different linked together by an ester, carbon or ether bond, said unit having the following formula:

$$CH_3—(C_nH_{2n})—R_1$$

wherein:

n is 4 or more, and $R_1$ is COOH, $COO^-M^+$, $COOR_2$ or $R_2$, preferably $COOR_2$, wherein:

M is a metal, preferably zinc, and $R_2$ is a substantially saturated organic chain having a backbone substantially comprising carbon-carbon, carbon-oxygen, or carbon-nitrogen linkages, or combinations thereof, wherein the backbone's pendent constituents are either —H or —OH and wherein at least one pendent constituent is —OH. The most preferred compatibilizer is obtained where n is 12 or more, and $R_1$ is $COOR_2$.

The paraffinic portion of the most preferred compatibilizer, $CH_3—(C_nH_{2n})—$, is generally very compatible with the asphalt. In general, the longer the chain, the more compatible the molecule will be with the asphalt, and therefore if the chain is relatively short, more compatibilizer molecules will generally be needed to suspend or invert the base material within the liquid prepolymer.

The semi-polar portion of the most preferred compatibilizer polymer, $—R_1$, has been found to be very compatible with polyisocyanate prepolymer, plasticizers, and most additives used in asphalt systems which are substantially non-polar, but have polar-organic portions, such as urethane-type polarity. In the preferred embodiment, the hydroxyl constituent(s) of the semi-polar portion of the polymer is compatible with the urethane linkage of the prepolymer (or any other organic segment having a polarity substantially similar to urethane).

In the preferred embodiment, the hydroxyl group(s) will tend to move to the urethane linkage(s) and will tend to pull the compatibilizer in relative close proximity to the pre-polymer molecule. In addition to the hydroxyl groups, the semi-polar portion of the preferred compatibilizer will also have hydrocarbon groups which are substantially non-polar and which are compatible with the non-polar portion, the asphalt.

As a result, the hydroxyl group will help suspend the urethane or similar type portion of the prepolymer, and the rest of the semi-polar portion of the prepolymer while the paraffinic portion of the compatibilizer will generally help suspend the base component. The compatibilizer lifts the base material and prepolymer into suspension within the prepolymer system, enabling them to be thoroughly and easily intermixed.

Regarding the paraffinic portion of the compatibilizer, the flexibility of the paraffinic chain is important and aids in the compatibilizer's ability to suspend the base component. Therefore any double or triple bonds or the like would be detrimental to the paraffinic portion.

Furthermore, the non-polar character of the paraffinic chain is also very important. Modifications to the paraffinic chain will generally be detrimental to the compatibilizer, if they make the non-polarity less uniform. In general, even slight deviation from a pure paraffinic chain will generally reduce compatibility.

The semi-polar portion of the compatibilizer however can be varied in a number of ways and is more difficult to define. As with the paraffinic portion, chain flexibility is also important. Chain flexibility aids in the compatibilizer's ability to suspend both the prepolymer and the base material.

The preferred prepolymer generally has numerous urethane linkages, as well as urea linkages and other components having some organic polarity. The polarity of the oxygen and nitrogen portions of the polymer backbone generally are very compatible with these portions of the prepolymer. As a result, although the semi-polar portion may be less able to suspend certain (non-polar) portions of the prepolymer due to the presence of oxygen or nitrogen, the increased chain flexibility enhances compatibility and the polarity due to the oxygen and nitrogen aids in suspending other polar portions of the prepolymer.

The ester linkage between the paraffinic portion and semi-polar portion has generally been found to be advantageous, although a precise explanation for this cannot be given. One explanation might be that the ester provides a stiff link between two very flexible portions of the compatibilizer molecule. Since the two portions are intended to suspend two different components, perhaps the ester aids in keeping the two portions separate and interactive with their intended component. Perhaps the relatively high polarity of the ester draws the hydroxy portion (and therefore the prepolymer) into close proximity to the paraffinic portion (and therefore the asphalt), thereby allowing improved intermixing. In any event, ester linkages are preferred within the transition zone between the paraffinic side and semi-polar side but are not preferred as part of either of these two sides. Hence the compatibilizer might be better visualized as having a paraffinic side, a transition portion and semi-polar side.

Fatty acids are relatively inexpensive and relatively plentiful. Numerous fatty acids were researched, and it was found that they generally provide noteworthy compatibility (significantly diminish the need for solvent in mixing base material and prepolymer). Metal salts of these fatty acids were also tried, using metals such as zinc, and the salts also provided noteworthy compatibility.

The fatty acids were then reacted with polyols and compatibility generally increased. Compatibility was best when a diol or polyol, particularly a diol, was used to thereby provide a paraffinic chain attached by an ester linkage to a flexible chain having one or more hydroxyl groups. Compatibility was generally better where only one hydroxyl group existed on the chain, preferably toward the terminal end of the chain.

Fatty acids were reacted with diols, particularly ethylene glycol and propylene glycol. The best compatibility was achieved when reacting stearic acid and propylene glycol to produce propylene glycol monostearate. The polystearate version of this molecule, bis stearyl ester polypropylene diol, also provided excellent compatibility.

Further work was therefore done, and it was found that the paraffinic/semi-polar molecule could be linked with another paraffinic/semi-polar molecule (either the same or different) with an ester, ether or carbon linkage, and the resulting molecule would generally work well as a compatibilizer. However three such molecules linked together generally did not give good compatibility results in the preferred embodiment.

Polyhydric alcohols were researched, particularly triethylene glycol. Triethylene glycol caprate caprylate and triethylene glycol dipelargonate both provided noteworthy compatibility, and it is believed that most alcohols reacted with a fatty acid will provide compatibility, at least to some degree. Polyols with ether groups were reacted with fatty acids and found to also provide exceptional compatibility.

Having read the present disclosure and with knowledge of the numerous compatibilizers described above, the ordinary artisan should easily be able to develop obvious variations of the preferred compatibilizer of this invention. Depending upon the end-use and performance requirements of the end-product, an obvious variation of the preferred embodiment may be more suitable.

For example, the greater the amount of base material to be compatibilized, typically the more important the paraffinic portion of the compatibilizer. Either the paraffinic chain should be very long or a large number of such chains should be present. If a lesser amount of asphalt is used, the optimal compatibilizer may be primarily dependant upon the semi-polar portion of the compatibilizer. If the prepolymer is substantially non-polar, then the semi-polar portion of the compatibilizer should generally be non-polar. If an increased amount of urethane portions are present or if the prepolymer is rather polar, then more hydroxyl groups may be required or more ether linkages to obtain the optimal compatibilizer.

It would be impossible to test and describe all possible variations of the preferred embodiment with respect to all possible base material-prepolymer systems and such has been left to the skills of the ordinary artisan after having read the present specification.

The compatibilizer preferably is present in the range of about 0.01% to about 5% with 0.1% being most preferred (all percentages herein are percentages by weight unless otherwise indicated).

The compatibilizer of this invention substantially diminishes the need for a volatile organic solvent, because the fatty acid derivative (or non-derivative) surprisingly provides sufficient miscibility among the material components to form a flowable, sufficiently intermixed system. The resulting material can be easily blended or mixed and can be pumped and sprayed.

The compatibilizer will not interfere with most chemical reactions commonly used in asphalt systems and can be used in a one-part or a two-part system. Unlike traditional organic solvents which can be an environmental and health hazard, the compatibilizer of the present invention is non-volatile and generally relatively non-toxic in comparison to conventionally known solvent systems.

Curing Of The Adhesive

The polymerization reaction of the isocyanate prepolymer is commonly referred to as "curing". Prior to curing, the mixture is substantially flowable at ambient temperatures, but after curing, the resulting polymer network is a non-flowable, non-moldable elastomeric solid.

Curing creates an adhesive bond between the roof deck and roofing insulation. The roofing insulation adhesive generally provides excellent sealant properties, because the asphalt component will generally penetrate into the roof deck surface, thereby providing the prepolymer with a substantial contacting surface upon which to bond as it cures.

The asphaltic material of the present invention is preferably stored and transported in its uncured state. The mixture is preferably applied and then allowed to cure. Curing can be initiated in a number of ways.

In a one-part system, curing is initiated and propagated by moisture, preferably humidity from the air. As a result, the uncured material is generally transported and stored in a substantially water-free environment. When the material is applied and exposed to ambient conditions, the moisture in the air will react with the prepolymer's isocyanate functional groups, creating an amine (urea) and giving off carbon dioxide as a by-product.

The amine will in turn readily and quickly react with any other isocyanate functional group present. The amine-isocyanate reaction is an addition reaction which links the two prepolymer chains together, creating as disubstituted urea functional group at the connection point of the two prepolymer chains. This curing reaction creates a polymer network within the base material which provides strength, cohesion, adhesion and elastomeric properties.

A plethora of other curing reactions could also be used. A secondary curing agent could be added to the one part system which would also react with moisture to create a reaction product (typically an amine) which would initiate and/or propagate the prepolymer polymerization. Such secondary curing agents are often found to be useful, because the curing reaction does not produce carbon dioxide as a bi-product which may be advantageous for certain applications. Secondary curing agents for one part isocyanate based polymerization reactions are well known in the art, such as oxazolidine or ketimine.

In a two-part system, a curative is mixed into the system just prior to application. In such systems, a large number of acceptable curatives are well known in the industry. Acids, amines, hydroxyl, or virtually any hydrogen or proton donating molecule can be used to initiate and propagate the polymerization of an isocyanate prepolymer.

One-part systems are generally preferred however, because end-users typically find that mixing prior to application is unduly burdensome, particularly if certain mixing equipment is necessary or if the length of time and quality of mixing has a small margin for error.

Regardless of whether a one-part or two-part system is used in the preferred embodiment, a large excess of isocyanate will often also advantageously create a strong cross-linked polymer network, because the urethane or disubstituted urea groups (created at the junction point of two prepolymers) can themselves react with isocyanate to form an allophanate (RNHCOHR-'COOR') in the case of a urethane reaction or a substituted biuret (RNHCONR'CONHR'') in the case of a disubstituted urea reaction.

Other Additives

Other additives can be added to modify the physical properties of the resulting compound. Optional ingredients which can be used include for example, those catalysts (i.e., imidizole tin or other known metal catalysts), fillers and additives conventionally used in base material isocyanate based polymers, such as antioxidants, protectants and the like. If the curing reaction gives off carbon dioxide (as when water reacts with an isocyanate functional group), an absorbent can be used, such as molecular sieve, to absorb the carbon dioxide, thereby substantially preventing unwanted bubbles or the like which may occur with the evolution of gases during curing.

Preferred fillers would include organoclays, Such fillers preferably comprise platelets having long chain organic compounds bonded to its two faces. When used as a filler and when the system is at rest, the organoclay's long chain components will agglomerate, making the system thick and solid-like. However, when a shearing force is applied, such as when the material is moved and/or applied, the long chain components will disperse, creating an emulsion which will aid in the flow properties of the material (the organo-clay will no longer thicken the material unless or until it once again comes to a rest and the long chain components once again agglomerate). Such fillers allow for easy application, since they do not substantially impede the flow capabilities of the compound while the compound is being applied, and such fillers also thicken the material once it comes to rest, thereby substantially preventing the material from flowing away from the area to which is was applied.

Other possible additives would include those modifiers and additives conventionally used in the formation of natural and synthetic elastomers. Such additives include flame retardants, reinforcements (both particulate and fibrous) heavy and light fillers, UV stabilizers, blowing agents, perfumants, antistats, insecticides, bacteriostats, fungicides, surfactants, and the like. Additionally, it should be recognized that additional conventional elastomers can be included as an ingredient in forming the asphalt material of this invention. Such additional elastomers include for example, polysulfide, EPDM, EPR ethylene, propylene diene monomer, ethylene propylene terpolymer, polychloroprene, polyisobutylene, styrene-butadiene rubber, nitrile rubber, and the like.

The Insulation Adhesive Is Substantially Solvent-free

The resulting material is free of solvent evaporation stress (i.e. cracking, blistering and the like) common to many solvent-based systems. The compatibilizer also surprisingly enhanced the resulting material "green strength"—that is, the ability of the asphalt adhesive to be tacky and to adhere during the transition period between the cured and uncured states. The high green strength of the present adhesive is advantageous, because the adhesive generally can be used without the need for clamps or similar-type devices since the material will adhere and bond virtually on contact. The adherence and bonding will increase as the curing progresses.

Preferred Method of Manufacturing

A one-part system is preferred since it eliminates the need for two-component mixing just prior to application, and the preferred method of manufacturing the one-step system, in which all reference to "parts" refers to "parts by weight" unless otherwise stated, is as follows:

1. The prepolymer is mixed at a slightly elevated temperature (140°190° F.) in a substantially water-free environment and comprises (in parts by weight of final material, not parts by weight of prepolymer material):
   a) about 20 to about 75 parts, and most preferably about 34 parts of about 2000 equivalent weight polyol;
   b) about 2 to about 15 parts, and most preferably 7 parts non-reactive diluent, preferably plasticizer;
   c) about 2 to about 20 parts and most preferably about 7 parts of about 150 equivalent weight diisocyanate; and
   d) a trace amount of catalyst (preferably tin) preferably at least about 0.01 parts.
2. The prepolymer preferably comprises about 20 to about 90 parts, preferably about 50 parts of the final material. The prepolymer is set aside and not used until step 10 below.
3. The asphalt component is heated in a substantially water-free environment to its softening point or until it is substantially a fluid. The amount of asphalt is preferably about 10 to about 80 parts, most preferably 38 parts. The asphalt should be continually heated to its softening point in a substantially water-free environment throughout the following manufacturing steps.

4. The non-reactive diluents (most preferably plasticizer(s)) are added to the heated asphalt. The amount of non-reactive diluents is preferably about 2 to about 20 parts, most preferably about 9 parts.
5. The blocking agent, preferably an anhydride, isocyanate or carbodiamide, is added. The preferred amount of blocking agent is about 0.2 to about 5 parts, most preferably about 0.6 parts.
6. The materials are mixed until all materials are dispersed or dissolved.
7. A catalyst is added (preferably tin, imidazole, or other metal catalyst). The preferred amount of catalyst is at least about 0.1 parts per million.
8. Mixing is continued and any desired additives are added (thickeners, thixotropes, antioxidants and protectants). The preferred amount of additives is about 2 to about 25 parts.
9. The compatibilizer is then added. The preferred amount of compatibilizer is at least about 0.01 parts, most preferably about 0.05 parts.
10. The prepolymer is added and the mixing is continued until all materials are dispersed or dissolved.
11. Allow the mixture to cool and store in a substantially water-free environment.

Example 1

1. The prepolymer was mixed at room temperature in a substantially water-free environment and comprises (in parts of final material, not parts of prepolymer material);
   a) 34 parts of a 2000 equivalent weight polyether triol;
   b) 7 parts butyl benzyl phthalate;
   c) 7 parts of diphenyl methane diisocyanate; and,
   d) a trace amount of tin catalyst, about 1 ppm.
2. The prepolymer was set aside in a substantially water-free environment and not used until step 10 below.
3. 38 parts of industrial grade asphalt was heated in a substantially water-free environment to its softening point. The asphalt was continually heated and mixed at its softening point in a substantially water-free environment throughout the following manufacturing steps.
4. About 9 parts of butyl benzyl phthalate was added to the heated asphalt.
5. 0.6 parts of maleic anhydride was then added to the heated asphalt.
6. The asphalt mixture was mixed for about 10 minutes until all materials were dispersed or dissolved.
7. A trace amount of tin catalyst was then added, about 0.05 parts, and the asphalt was mixed for about 2 hours.
8. 1 weight part of a precipitated silica thixotrope filler and about 4 parts of a calcium carbonate particle filler was then added.
9. 0.5 parts of propylene glycol monostearate was then added.
10. The asphalt was mixed until all the materials were dispersed or dissolved and then the prepolymer was added and mixed about 30 minutes until all materials are dispersed or dissolved.
11. The final mixture was allowed to cool and was stored in a substantially water-free environment.

The above mixture was tested as an insulation adhesive and found to properly cure overnight to a commercially acceptable elastomer under most common outdoor weather conditions. The overnight relative humidity can be as low as about 30% and the overnight temperature can be as low as about 0° F. and the material will properly cure in about 10 to about 20 hours. At higher temperatures and relative humidities, the material will cure much more quickly.

The cure time can be adjusted by increasing or decreasing the amount of catalyst in the formulation or by adding an intermediate water curing component in place of the catalyst, such as oxazolidine or ketimine. The oxazolidine or ketimine can be added in place of the catalyst in an amount of about 0.1 to about 2 parts, preferably about 0.5.

Upon curing, the resulting product of Example 1 had excellent peel adhesion, tensile adhesion and lap shear. The material was very durable and water and weather resistant.

Alternatively, a two-part adhesive can be manufactured wherein the above material is mixed with an amine or other hydrogen donating compound just prior to application. The amine will react with the prepolymer typically much more readily than will water. As a result, the material will cure much more quickly and will not significantly react with water (and therefore will not significantly give off carbon dioxide as a by-product).

Alternatively, a blocking group can be incorporated onto the isocyanate functional groups so that the material will not react with water. A curative can then be mixed with the material just prior to application which will remove the blocking group and initiate and/or propagate curing.

The chemistry relating to polymerization of isocyanate prepolymers is well developed and a full discussion of one component and two component curing systems would be so voluminous as to be inappropriate in light of the fact that the present invention is not directed to any particular curing system. An exhaustive discussion of curing systems is unnecessary and may obscure the present invention. Such curing systems are readily known or can be readily developed by an ordinary artisan, using routine experimentation and knowledge well known in the art.

The above discussion has been provided to aid in the understanding of the present invention. Details provided above are provided primarily to help the ordinary artisan visualize the preferred embodiment and the innumerable other possible embodiments of this invention, and such details are not intended to create any limitations to this invention. Many improvements and modifications are certainly possible and it would be impossible to explicitly describe every conceivable aspect of the present invention. Therefore, the failure to describe any such aspect is also not intended to create any limitation to the present invention. The limitations of the present invention are defined exclusively in the following claims and nothing within this specification is intended to provide any further limitation thereto.

What is claimed is:

1. A roofing system, said system comprising:

a roof deck comprising a metal, concrete, gypsum or wood substrate, and rigid panel roofing insulation including prefabricated boards and poured insulating concrete fills having adequate shear strength to distribute tensile stresses in a membrane to prevent it splitting, compressive strength to withstand traffic, and adhesive and cohesive strength to resist delamination due to wind uplift forces up to 90 $lb/ft^2$, secured thereto with a dispersion of asphalt which is liquid or semi-liquid at room temperature, suspended within a liquid isocyanate end-capped polyurethane prepolymer as an adhesive;

wherein said roof deck has a slope less than 25° C. relative to the horizontal, said adhesive in its uncured state is substantially flowable, comprising asphalt and a compatibilizer and optionally a filler or a non-reactive diluent, dispersed in at least about 20 weight percent of a curable polyisocyanate prepolymer, wherein said compatibilizer has a non-polar component and a polar organic component, and is a polymeric material consisting essentially of a polymer unit, or two such units being either identical or different and linked together by an ester, carbon or ether bond, said unit having the following formula:

$$CH_3—(C_nH_{2n})—R_1$$

wherein: n is 4 or more, and $R_1$ is COOH, $COO^-M^+$, $COOR_2$ or $R_2$, wherein: M is a metal, and $R_2$ is a saturated organic chain having a backbone comprising carbon-carbon, carbon-oxygen, or carbon-nitrogen linkages, or combinations thereof, wherein the backbone's pendent constituents are either —H or —OH and wherein at least one pendent constituent is —OH, and said adhesive cures within 10 hr to secure said insulation to said roof deck without mechanical fasteners.

2. The roofing system of claim 1 including applying about 50 ml (0.012 gal) of said adhesive to secure about a 900 $cm^2$ (1 $ft^2$) of rigid board roofing insulation panel to a clean surface of 18 gauge cold rolled steel deck having ribs spaced apart at about 15 cm (6 ins) on center, said ribs having a depth of about 2.5 cm (1 in) or greater and a width of about 2.5 cm (1 in) or more, and said adhesive is cured at a temperature in the range of about 18°-22° C. and a relative humidity between about 35% and 95%.

3. The roofing system of claim 2 wherein the cure time is less than 2 hrs.

4. The roofing system of claim 1, wherein said dispersion is stable at room temperature for at least about 30 days.

5. The roofing system of claim 1 wherein said compatibilizer is selected from the group consisting of propylene glycol monostearate, bis stearyl ester polypropylene diol, ethylene glycol monostearate, triethylene glycol caprate caprylate and triethylene glycol dipelargonate.

6. The roofing system of claim 2 wherein the adhesive comprises:

about 15 to about 75 weight percent base material;

at least about 0.01 weight percent compatabilizing agent;

about 25 to about 75 weight percent isocyanate prepolymer.

7. The roofing system of claim 2 wherein said polyurethane adhesive is formed with from about 25 to about 65 percent by weight polyol and, from about 5 to bout 20 percent by weight diisocyanate in the presence of from about 5 to about 20 percent by weight plasticizer.

8. A method of securing a rigid insulation panel to a roof deck without mechanical fasteners, said method comprising:

applying to said roof deck comprising a metal, concrete, gypsum or wood substrate, a one-part substantially solvent-free adhesive readily curable at ambient temperature and humidity, having wetting and interdiffusion capability comprising a dispersion of asphalt which is liquid or semi-liquid at room temperature, suspended within a liquid isocyanate end-capped polyurethane prepolymer which is substantially solvent-free in combination with an effective amount of plasticizer and compatibilizer sufficient to maintain said dispersion in which said liquid prepolymer can wet the surface of said deck and also the surface of said insulation panel, wherein said compatibilizer has a non-polar component and a polar organic component, and is a polymeric material consisting essentially of a polymer unit, or two such units being either identical or different and linked together by an ester, carbon or ether bond, said unit having the following formula:

$$CH_3—(C_nH_{2n})—R_1$$

wherein: n is 4 or more, and $R_1$ is COOH, $COO^-M^+$, $COOR_2$ or $R_2$, wherein: M is a metal, and $R_2$ is a saturated organic chain having a backbone comprising carbon-carbon, carbon-oxygen, or carbon-nitrogen linkages, or combinations thereof, wherein the backbone's pendent constituents are either —H or —OH and wherein at least one pendent constituent is —OH;

placing said rigid panel in contact with said adhesive, said panel including prefabricated boards and poured insulating concrete fills having adequate shear strength to distribute tensile stresses in a membrane to prevent it splitting, compressive strength to withstand traffic, and adhesive and cohesive strength to resist delamination due to wind uplift forces, and thereafter, curing said adhesive within less than 10 hour to provide 90 $lb/ft^2$ uplift resistance in less than 24 hr, wherein said roof deck has a slope less than 25° C. relative to the horizontal, said adhesive prior to being cured, is non-aqueous, substantially flowable, and includes at least about 10 percent by weight of said prepolymer which is curable under said ambient conditions upon application to said roof deck.

9. The method of claim 8 including applying about 50 ml (0.012 gal) of said adhesive to secure about a 900 $cm^2$ (1 $ft^2$) of rigid board roofing insulation panel to a clean surface of 18 gauge cold rolled steel deck having ribs spaced apart at about 15 cm (6 ins) on center, said ribs having a depth of about 2.5 cm (1 in) or greater and a width of about 2.5 cm (1 in) or more, whereby after a cure time of less than about 24 hours at a temperature in the range of about 18°-22° C. and a relative humidity between about 35% and 95%.

10. The method of claim 9 wherein the cure time is less than about 2 hrs.

11. The method of claim 8 wherein said dispersion is stable at room temperature for at least about 30 days.

12. The method of claim 11 wherein n is 12 and $R_1$ is $COOR_2$.

13. The method of claim 12 wherein said compatibilizer is selected from the group consisting of propylene glycol monostearate, bis stearyl ester polypropylene diol, ethylene glycol monostearate, triethylene glycol caprate caprylate, and triethylene glycol dipelargonate.

14. The method of claim 11 wherein said adhesive comprises:

from about 15 to about 75 percent by weight asphalt;

at least about 0.01 percent by weight of compatibilizing agent; and, from about 25 to about 75 percent by weight isocyanate prepolymer.

15. The method of claim 14 wherein said prepolymer comprises:

from about 25 to about 65 percent by weight polyol, from about 5 to about 20 percent by weight plasticizer, and from about 5 to about 20 percent by weight diisocyanate.

16. A method of securing a rigid panel to a roof deck without mechanical fasteners, said method comprising:

applying to said roof deck comprising a metal, concrete, gypsum or wood substrate, a multiple part substantially solvent-free adhesive, readily curable at ambient temperature and humidity, having wetting and interdiffusion capability, one part comprising a dispersion of asphalt which is liquid or semi-liquid at room temperature, suspended within a liquid polyol in combination with an effective amount of non-reactive diluent and compatibilizer sufficient to maintain said dispersion, and a second part comprising a polyisocyanate in an amount sufficient, upon being cured, to form a polyurethane with said polyol, wherein said compatibilizer has a non-polar component and a polar organic component, and is a polymeric material consisting essentially of a polymer unit, or two such units being either identical or different and linked together by an ester, carbon or ether bond, said unit having the following formula:

$$CH_3—(C_nH_{2n})—R_1$$

wherein: n is 4 or more, and $R_1$ is COOH, $COO^-M^+$, $COOR_2$ or $R_2$ wherein: m is a metal, and, $R_2$ is a saturated organic chain having a backbone comprising carbon-carbon, carbon-oxygen, or carbon-nitrogen linkages, or combinations thereof, wherein the backbone's pendent constituents are either —H or —OH and wherein at least one pendent constituent is —OH, placing said rigid panel in contact with said adhesive, said panel including prefabricated boards and poured insulating concrete fills having adequate shear strength to distribute tensile stresses in a membrane to prevent is splitting, compressive strength to withstand traffic, and adhesive and cohesive strength to resist delamination due to wind uplift forces, and thereafter, curing said adhesive within less than 10 hour to provide 90 $lb/ft^2$ uplift resistance in less than 24 hr, wherein said roof deck has a slope less than 25° C. relative to the horizontal, said adhesive is substantially flowable, and includes at least about 20 percent by weight of said polyol and polyisocyanate which are together curable under ambient conditions upon application to said roof deck.

17. The method of claim 16 wherein said non-reactive diluent is a plasticizer selected from the group consisting of dibutoxyethyl phthalate, diisodecyl phthalate, dibutyl phthalate, butylbenzyl phthalate, dioctyl phthalate, dioctyl sebacate, dioctyl adipate, diethylbutyl sebacate, dibutoxyethocyethyl sebacate, dibutoxyethyl sebacate, dibutyl sebacate, dioctyl dodecanedioate, diisooctyl dodecanedioate, dioctyl sebacate, dioctyl sebacate (substituted), triisooctyl trimellitate, trioctyl trimellitate, diisooctyl adipate, dioctyl adipate, dioctyl azelate, long chain alkyl alkylether diester, dialkyl diether glutarate, dibutyoxyethoxyethyl glutarate, dibutoxyethyl glutarate, tributyl phosphate, and still bottom phosphate plasticizers, and, said compatibilizer is a fatty acid ester of an alkylene diol.

18. The method of claim 17 wherein said compatibilizer is selected from the group consisting of propylene glycol monostearate, bis stearyl ester polypropylene diol, ethylene glycol monostearate, triethylene glycol caprate caprylate, and triethylene glycol dipelargonate.

* * * * *